US005578125A

United States Patent [19]

Sieberth

[11] Patent Number: 5,578,125

[45] Date of Patent: Nov. 26, 1996

[54] COATING SYSTEM FOR RUNNING WEBS OF PAPER OR CARDBOARD

[75] Inventor: Ralf Sieberth, Appleton, Wis.

[73] Assignee: Voith Sulzer Papiermaschinen GmbH, Heidenheim, Germany

[21] Appl. No.: 344,134

[22] Filed: Nov. 23, 1994

[30] Foreign Application Priority Data

Nov. 24, 1993 [DE] Germany ..... 43 40 039.6

[51] Int. Cl.[6] ..... B05C 1/00

[52] U.S. Cl. ..... 118/257; 118/261; 118/410; 118/413; 118/419

[58] Field of Search ..... 118/106, 118, 118/123, 239, 257, 261, 325, 410, 413, 419; 162/265

[56] References Cited

U.S. PATENT DOCUMENTS

| | | | |
|---|---|---|---|
| 3,866,566 | 2/1975 | Jones | 118/239 |
| 4,030,444 | 6/1977 | Collins et al. | 118/257 |
| 4,968,534 | 11/1990 | Bogardy | 118/410 |
| 5,101,760 | 4/1992 | Sollinger | 118/410 |
| 5,252,186 | 10/1993 | Sollinger et al. | 162/273 |
| 5,437,760 | 8/1995 | Benkowski et al. | 118/70 |

FOREIGN PATENT DOCUMENTS

| | | |
|---|---|---|
| 1425060 | 3/1971 | Germany . |
| 7640002 | 12/1977 | Germany . |
| 9070025 | 10/1990 | Germany . |
| 4105215 | 8/1992 | Germany . |
| 61-46276 | 3/1986 | Japan . |
| 1400146 | 7/1975 | United Kingdom . |
| 2103115 | 2/1983 | United Kingdom . |

OTHER PUBLICATIONS

Voith Brochure, Dynamic Coater, Dr. Ing. Hans-Peter Sollinger, Oct. 1987.

*Primary Examiner*—Laura Edwards
*Attorney, Agent, or Firm*—Baker & Daniels

[57] ABSTRACT

The invention concerns a coating system for running webs of cardboard or paper which are carried, or backed, by at least two moving surfaces, in which system the coating substance is applied first on at least one moving surface carrying the web and thereafter transferred, in a press gap formed by the moving surfaces, on the web on one or both sides. The invention is characterized by the following features: the moving surfaces are formed by two continuous belts; the belts proceed jointly with the web contained in between successively through a first press gap and through a second press gap, with each press gap being formed by two rolls that are movable relative to each other; the rotatable roll body of each of the rolls of the second press gap is backed against flexure by means of a stationary element; the diameter of the rolls of the second press gap amounts to maximally one-half, preferably less than one-third, of the diameter of the rolls of the first press gap.

15 Claims, 1 Drawing Sheet

COATING SYSTEM FOR RUNNING WEBS OF PAPER OR CARDBOARD

BACKGROUND OF THE INVENTION

The invention concerns a coating system for running webs of paper or cardboard carried by two moving surfaces wherein the coating substance is first applied on one moving surface carrying the web and then transferred in a press gap to one or both sides of the web. Such a system is known from GB-B 21 03 115. In this system, both size and pigmented dye can be used as coating medium. The two press rolls form a press gap through which the web is passed and in which the coating substance, which is contained on the shell surface of the press rolls after having previously been applied there in dosed fashion, is transferred. This device is usable for relatively high web speeds. But with web widths, the lengths of press rolls and notably their diameters becoming ever larger today, high web speeds involve the risk of so-called film splitting; refer in this respect to FIGS. 12 and 13 of the VOITH Publication No. "p 2766". Film splitting occurs on the exit side of the press gap as the shell surfaces of the two press rolls diverge from each other. This effect is influenced by the adhesion of the coating substance to the press rolls and a relatively slight pressure in the coating substance in this area. The result is a reduction in the surface quality of the finished paper or cardboard web.

As regards the prior art, reference, for the sake of completeness, is made to DE-GM 90 07 025, DE 14 25 060 and U.S. Pat. No. 5,252,186.

SUMMARY OF THE INVENTION

The problem underlying the invention is to avoid the occurrence of the described effect. In a system of the initially cited type, this problem is solved by forming the moving surfaces by two continuous belts which proceed with the web contained between them successively through a first press gap and a second press gap, with each press gap being formed by two rolls that are moveable relative to each other. The rotatable body of each of the rolls of the second press gap is backed against flexure by means of a stationary element. The diameter .of the rolls of the second press gap amounts to maximally one-half and preferably less than one-third of the diameter of the rolls of the first press gap.

The system can be constructed very simply by providing for each web only two additional reversing rolls of small diameter, in addition to the press rolls. The diameter of the press rolls plays in this case no longer the decisive role and it therefore may be very large. Of the reversing rolls, which are arranged directly on the web and preferably directly in the direction of web or belt travel or directly after the press gap, at least one may be movable relative to the other corresponding reversing roll. This way, the two press rolls can be pressed onto each other with a contact pressure between 10 and 40 kN/m web width.

The invention is based on the insight that the aforementioned film splitting can at least extensively be avoided in that the rolls of the second press gap have a relatively small diameter and, therefore, are by means of a stationary element backed against flexure. Such support may be designed differently. For example, each of the rolls of the second press gap can be fashioned as a flexural adjustment roll. Alternatively, the rolls of the second gap can feature a stationary central longitudinal beam and a segmented roll shell installed on it. Still further, the roll shell of each of the rolls of the second press gap can rest on a stationary support body which extends essentially across the entire length of the roll shell.

As usual, so-called nozzle applicators are in such systems used for the application of the coating substance on the belts. The belts may consist of a plastic material, such as for instance polyamide or polyamidimid. Owing to the small diameter (less than 300 mm) of at least the small reversing rolls on the web, the belts with the adhering coating substance separate quickly from the web, so that the initially described, retroactive effect is reduced quite considerably and no longer plays a decisive role.

The small reversing rolls, notably those arranged on the web, may be fitted, similar to those of expander drums, with a segmented shell and a rigid, central longitudinal beam. A roll of that type is known, e.g., from DE 14 25 060, incorporated herein by reference.

BRIEF DESCRIPTION OF THE DRAWINGS

The invention will be illustrated basically hereafter with the aid of the attached drawing.

DETAILED DESCRIPTION

Figure 1:
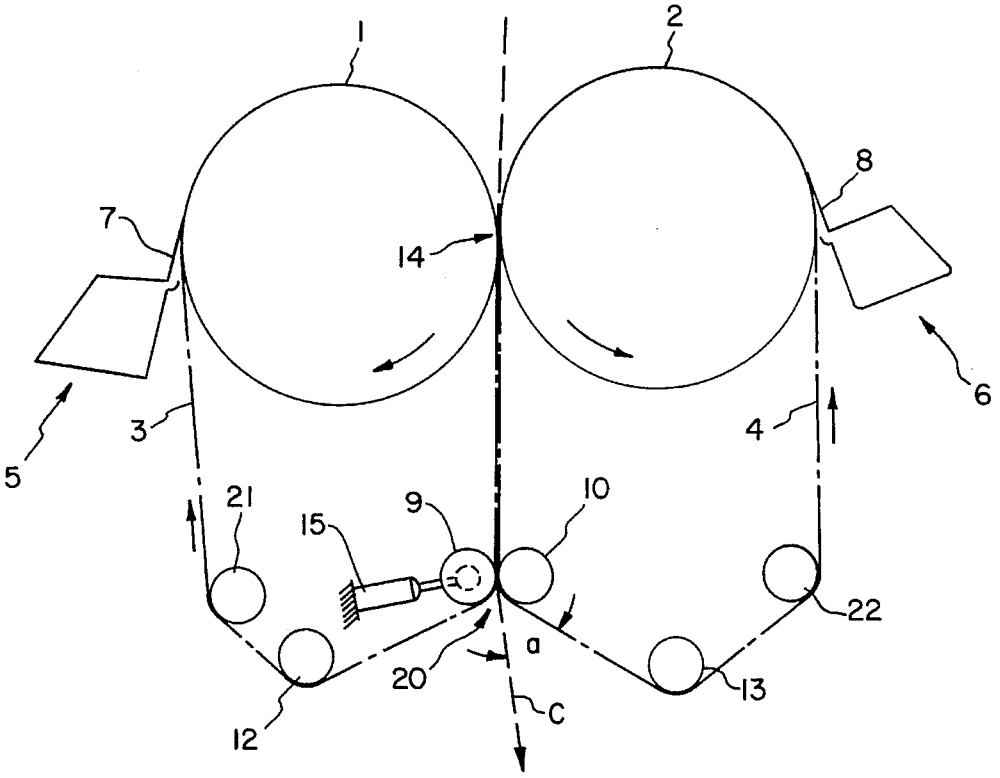
FIG. 1 is a schematic illustration of one embodiment of the present invention.

Indicated by their circumference are two press rolls 1 and 2 which between themselves form a press gap 14 through which passes the web C. Each of the press rolls is wrapped by a belt 3, respectively 4, guided by further reversing roll 9, 10, respectively 12, 13, 21 and 22 in an endless loop. In the area of the press rolls wrapped by the relevant belt (i.e., the wrap area) a nozzle applicator system, 5 and 6 respectively, is provided for coating the belts with the coating substance. In this case, a doctor blade 7 and 8 each is indicated, to effect a dosing of the applied amount of coating substance. A roll doctor bar with peripheral grooves (not shown) may preferably also be employed at this point. These grooves are created by wire lapping, the cross section of the these grooves ranging between 0.004 and 0.15 $mm^2$. However, these are not rigid limit values.

A line pressure of generally 10 and 40 kN/m, possibly up to 60 kN/m (that is, per each meter of web width), is present in the press gap 14 formed between the press rolls. As indicated, at least one of the reversing rolls 9 and 10 contained on the web is forced down by a hydraulically or pneumatically operating holddown system 15 at a line pressure between 10 and 60 kN/m, so as to create here the final press gap 20.

A nozzle applicator 5, 6 each may preferably be employed as applicator system for the coating substance. The reversal angle formed by the web and the belts at the end of the second press gap, as exemplified by angle a formed between web C and belt 4 in FIG. 1, amounts to at least 20° for the small press rolls 9, 10.

Of course, it is also possible to use more small reversing rolls per belt, for instance to reduce the wrap angle of the belts. One of these reversing rolls may then be used also for tensioning the relevant belt and may be provided, as explained, with a tensioning device.

The reversing rolls are preferably segmented and equipped with an interior beam.

Figure 2:
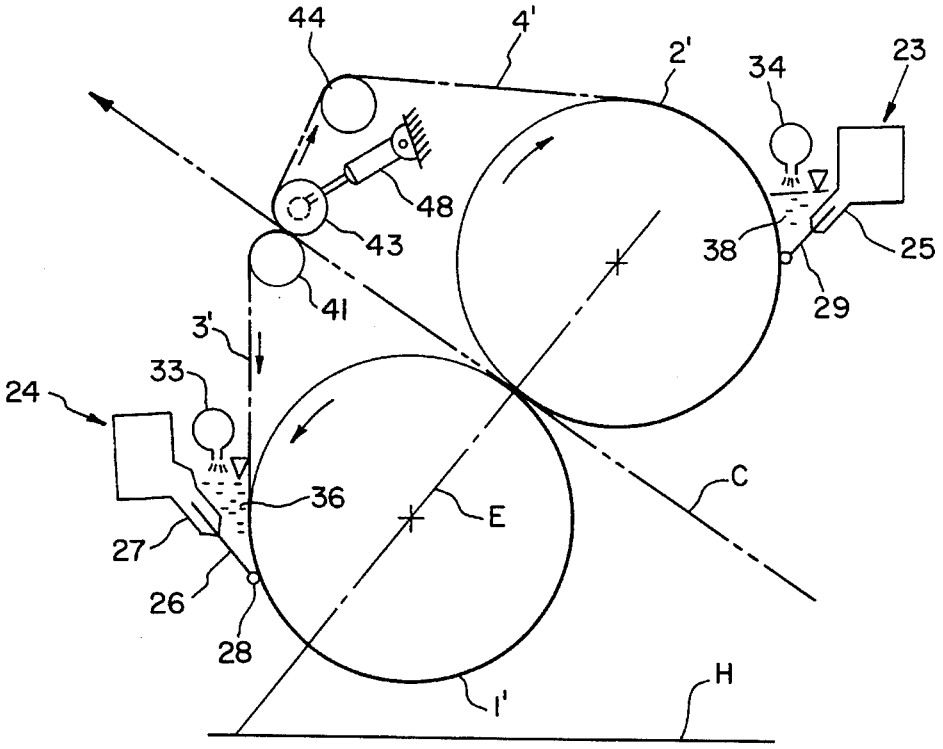
FIG. 2 is a schematic drawing of a second embodiment of the present invention.

FIG. 2 shows a variant where the press rolls 1' and 2' and the press belts 3' and 4' passing around them are coordinated each with a sump applicator 23, respectively 24. The applicator 24 features a holder 26 retained in a clamping system 27, for use with a roll doctor 28; similarly, the applicator 23 has a clamping system 25 for a corresponding holder 29. However, the clamping system may also serve to hold doctor blades, as in the case of FIG. 1. A sump 36 respectively 38 each is formed on the holder 26 respectively 29 respectively on the clamping systems 27 and 25. The coating substance is fed to the sump via pipes 33 and 34. Additional reversing rolls 41, respectively 43 and 44, guide the belts, with a hydraulic power mechanism 48 being coordinated with the reversing roll 43 for forcing it against the reversing roll 41. The connecting plane E between the center axes of the two press rolls 1' and 2' has in relation to the horizontal H an angle of somewhat over 50°. This angle could also be dimensioned approaching practically zero. The latter, of course, would lead to a somewhat less favorable progression of the paper web C.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for coating running webs of paper or cardboard comprising:

at least two continuous belts that move in unison through a first press gap and a second press gap, each said gap being formed by two rolls that are moveable relative to each other, each of said rolls having a diameter, said at least two belts carrying the web through said press gaps; and means for applying a coating substance to one of said at least two belts, said applying means being in fluid communication with said one belt, the coating substance being transferred by said one belt to at least one side of the web in the first press gap;

each of said second press gap rolls including a roll body that is backed against flexure by means of a stationary element;

wherein the diameter of each of said second press gap rolls is maximally one-half of the diameter of each of said first press gap rolls.

2. The system according to claim 1 wherein the diameter of said second press gap rolls is maximally 300 mm.

3. The system according to claim 1 wherein each of said second press gap rolls is a flexural adjustment roll.

4. The system according to claim 1 wherein each of said second press gap rolls features a stationary, central longitudinal beam and a segmented roll shell installed on said beam.

5. The system according to claim 1 wherein each of said second press gap rolls includes a roll shell that rests on a stationary support body which extends essentially across an entire length of the roll shell.

6. The system according to claim 1 wherein each of said at least two belts forms a reversal angle with the web at the end of said second press gap and each of said reversal angles is at least 20°.

7. The system according to claim 1 wherein the diameter of each of said second press gap rolls is maximally 250 mm and each of said at least two belts forms a reversal angle with the web at the end of said second press gap, each of said reversal angles being at least 70°.

8. The system according to claim 1 wherein the coating of the at least two belts takes place in a wrap area of said first press gap rolls.

9. The system according to claim 1 wherein said means for coating comprises a nozzle applicator.

10. The system according to claim 1 wherein said means for coating comprises a sump applicator equipped with a doctor.

11. The system of claim 10 wherein said sump applicator includes a holder.

12. The system according to claim 10 wherein said means for coating comprises a second sump applicator equipped with a doctor, said applicators applying a coating to each of the at least two belts of said first press gap.

13. The system according to claim 12 wherein a connecting plane extending through the center axes of said first press gap rolls is tilted between 0° and 55° relative to a horizontal plane.

14. The system of claim 1 wherein the diameter of said second press gap rolls are maximally one-third of the diameter of said first press gap rolls.

15. The system according to claim 1 wherein said means for coating comprises two nozzle applicators for applying coating on each of the at least two belts of said first press gap.

* * * * *